US011207560B2

(12) United States Patent
Wang

(10) Patent No.: US 11,207,560 B2
(45) Date of Patent: Dec. 28, 2021

(54) PULL-UP FITNESS EXERCISE MACHINE WITH A GRIP BAR HANGING FRAME STRUCTURE FOR A HANG-UP TRAINING

(71) Applicant: Leao Wang, Taichung (TW)

(72) Inventor: Leao Wang, Taichung (TW)

( * ) Notice: Subject to any disclaimer, the term of this patent is extended or adjusted under 35 U.S.C. 154(b) by 67 days.

(21) Appl. No.: 16/817,631

(22) Filed: Mar. 13, 2020

(65) Prior Publication Data

US 2021/0283463 A1 Sep. 16, 2021

(51) Int. Cl.
*A63B 23/12* (2006.01)
*A63B 22/00* (2006.01)

(52) U.S. Cl.
CPC ..... *A63B 23/1218* (2013.01); *A63B 22/0002* (2013.01)

(58) Field of Classification Search
CPC ..... A63B 23/1218; A63B 22/0002; A63B 21/068; A63B 21/151; A63B 21/154; A63B 21/4035; A63B 21/00185
See application file for complete search history.

(56) References Cited

U.S. PATENT DOCUMENTS 9,415,293 B1 * 8/2016 Wang ..... A63B 23/1218
2017/0189734 A1 * 7/2017 Wang ..... A63B 21/00181
2018/0015325 A1 * 1/2018 Wang ..... A63B 23/1218

FOREIGN PATENT DOCUMENTS

CN 210384728 U * 8/2019 ..... A63B 21/068

* cited by examiner

*Primary Examiner* — Andrew S Lo
*Assistant Examiner* — Andrew M Kobylarz

(57) ABSTRACT

A pull-up fitness exercise machine with a grip bar hanging frame structure for a hang-up training includes a support board. The support board is automatically lifted upward by a pushing unit for the user to take an expected pull-up exercise. The pushing unit is activated by an electric adjusting element in a mechanism box unit for a proper adjustment of the pushing force. The support board is provided with a hand-operated switch unit and a foot-operated switch unit for cooperating with their corresponding barbed hooks respectively, such that the support board can always be kept at a relatively low position in the case that the foot-operated switch group is not stressed. A hanging frame having a plurality of corresponding hanging bars is positioned on both top ends of the front frame for providing a random hanging of a grip bar with a safety sling.

2 Claims, 5 Drawing Sheets

PULL-UP FITNESS EXERCISE MACHINE WITH A GRIP BAR HANGING FRAME STRUCTURE FOR A HANG-UP TRAINING

BACKGROUND OF THE INVENTION

1. Fields of the Invention

The invention relates to a pull-up fitness exercise machine with a grip bar hanging frame structure for a hang-up training, and more particularly, to a pull-up fitness exercise machine that can achieve the basic upward lifting effect so that the user can easily practice the pull-up movement. Moreover, a grip bar, which can be arbitrarily shifted, is employed to perform a hang-up shift training. Meanwhile, the position of the grip bar can be randomly changed to greatly increase the variability of the exercise and the fun of hang-up training.

2. Description of the Related Art

According to U.S. Pat. Nos. 9,415,293, 9,855,457, and 10,004,944, a pull-up fitness exercise machine disclosed by the same applicant of the invention refers to an indoor sports equipment that simulates the "horizontal bar" or "lifting ring" exercise of gymnastics. It can provide an appropriate and presetable upward pushing force to the support plate by the auxiliary pushing element, so as to help the user to easily apply force and lift his body for taking an expected pull-up exercise. Since the motion mode, the mechanism composition, and related operation and usage of the "pull-up fitness exercise machine" have already been detailed in the previous application documents, they will not be repeated here.

The above-mentioned grip bar or lifting ring can be fixed in a desired position before use. However, the position of the grip bar or the lifting ring has been limited by the body's stretching stroke and cannot be arbitrarily changed. Therefore, the user will easily feel tired and impatient, and gradually lose the using interest due to the same stretching exercise state for a long time. Of course, the user can also stop and adjust the vertical position of the grip bar or lifting ring after an exercise session before continuing to use. However, the user's willingness to take another exercise session will be instantly cooled down or given up, thereby reducing the practical value of this sports equipment.

SUMMARY OF THE INVENTION

A primary object of the invention is to provide an pull-up fitness exercise machine with a grip bar hanging frame structure for a hang-up training through which the grip bar is designed in an open mode that can be randomly lifted, so as to place against different hanging bars in different positions. On the one hand, users can train their arms and core muscles to achieve the desired training purpose. On the other hand, they can train the flexible coordination between the brain and hands. In particular, if the pull-up fitness exercise machine can be supplemented with the teaching guidance of a professional coach, it will be able to achieve the best practical benefits.

According to the invention, a pull-up fitness exercise machine with a grip bar hanging frame structure for a hang-up training includes a support board. The support board is automatically lifted upward by a pushing unit for the user to take an expected pull-up exercise. The pushing unit is activated by an electric adjusting element in a mechanism box unit for a proper adjustment of the pushing force. The support board is provided with a hand-operated switch unit and a foot-operated switch unit for cooperating with their corresponding barbed hooks respectively, such that the support board can always be kept at a relatively low position in the case that the foot-operated switch group is not stressed. The whole machine body consists of a left and right symmetrical front frame and a rear frame having a forward extension rail. The bottom end of the front frame naturally forms two front ground feet, and further forms a solid ground support together with the bottom end of the rear frame. The mechanism box unit and a supporting plate link are pivotally connected to a pivot shaft of the rear frame. The pushing unit is further pivoted between the mechanism box unit and the extension rail. A hanging frame having a plurality of corresponding hanging bars is positioned on both top ends of the front frame for providing a random hanging of a grip bar with a safety sling.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
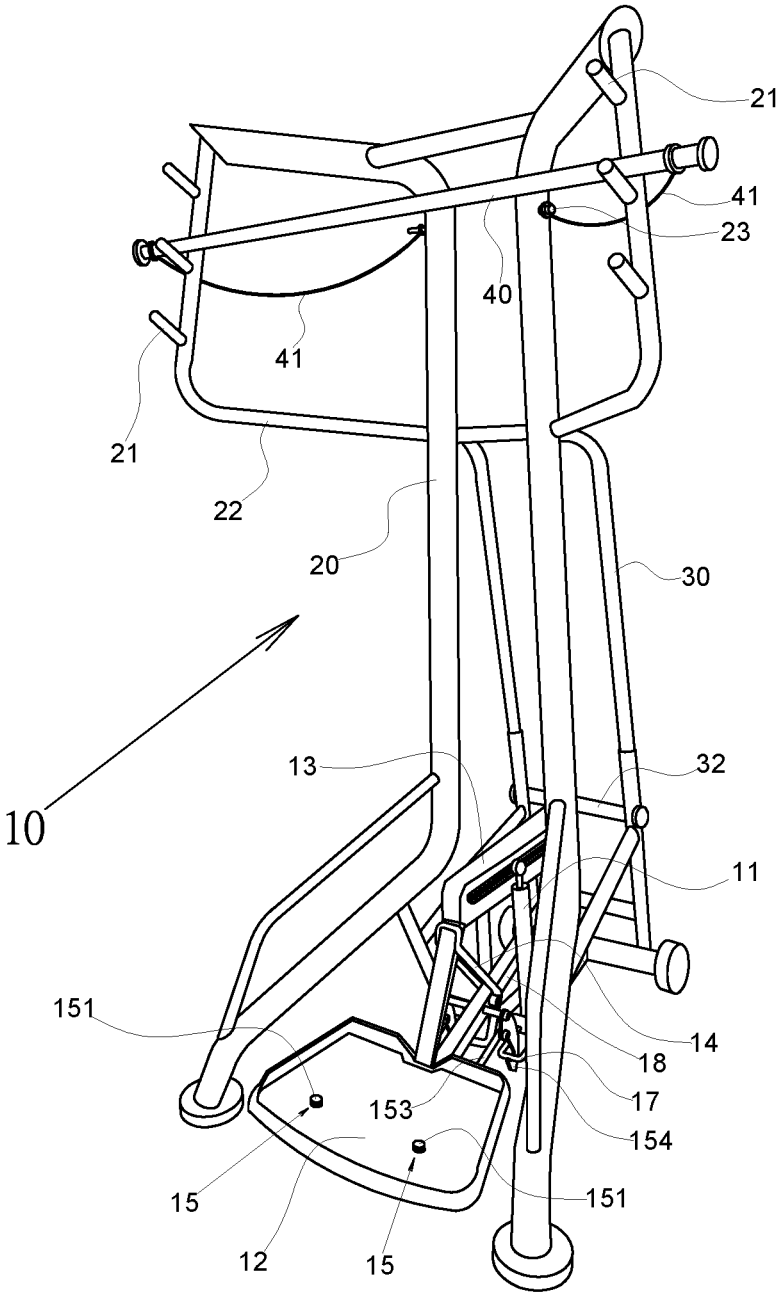
FIG. 1 is a perspective assembly view of a preferred embodiment of the invention.

The present invention will now be described in more detail hereinafter with reference to the accompanying drawings that show various embodiments of the invention.

Referring to FIGS. 1 through 4, a pull-up fitness exercise machine 10 according to the invention include a support board 12 which can be automatically lifted upward by a pushing unit 11 for the user to take an expected pull-up exercise. The pushing unit 11 is activated by an electric adjusting element (not shown) in a mechanism box unit 13 so that the user can properly adjust the pushing force by himself. The support board 12 is provided with a hand-operated switch unit 14 and a foot-operated switch unit 15 for cooperating with their corresponding barbed hooks 16, 17 respectively, such that the support board 12 can always be kept at a relatively low position in the case that the foot-operated switch group 15 is not stressed.

The whole machine body of the invention consists of a left and right symmetrical front frame 20 and a rear frame 30 having a forward extension rail 31. The bottom end of the front frame 20 naturally forms two front ground feet, and further forms a solid ground support together with the bottom end of the rear frame 30. The mechanism box unit 13 and a supporting plate link 18 are pivotally connected to a pivot shaft 32 of the rear frame 30. The pushing unit 11 is further pivoted between the mechanism box unit 13 and the extension rail 31. A hanging frame 22 having a plurality of corresponding hanging bars 21 is positioned on both top ends of the front frame 20 for providing a random hanging of a grip bar 40 with a safety sling 41.

The related functions and linkages of the basic components such as the pushing unit 11, the support board 12, the mechanism box group 13 and the related electric adjustment elements mentioned above have been disclosed in the documents of another invention of the applicant and are not the object of the invention so that no further descriptions thereto are given hereinafter.

Figure 2:
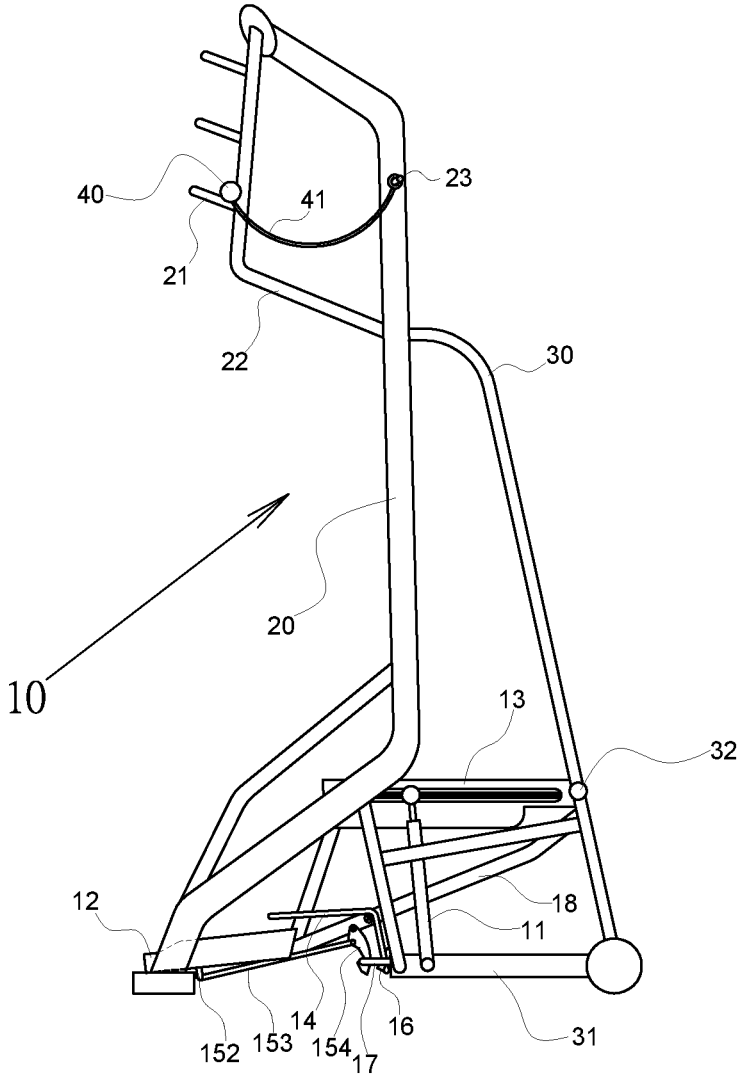
FIG. 2 is a side view of the preferred embodiment of the invention, wherein the support board is at the normal low point.
Figure 3:
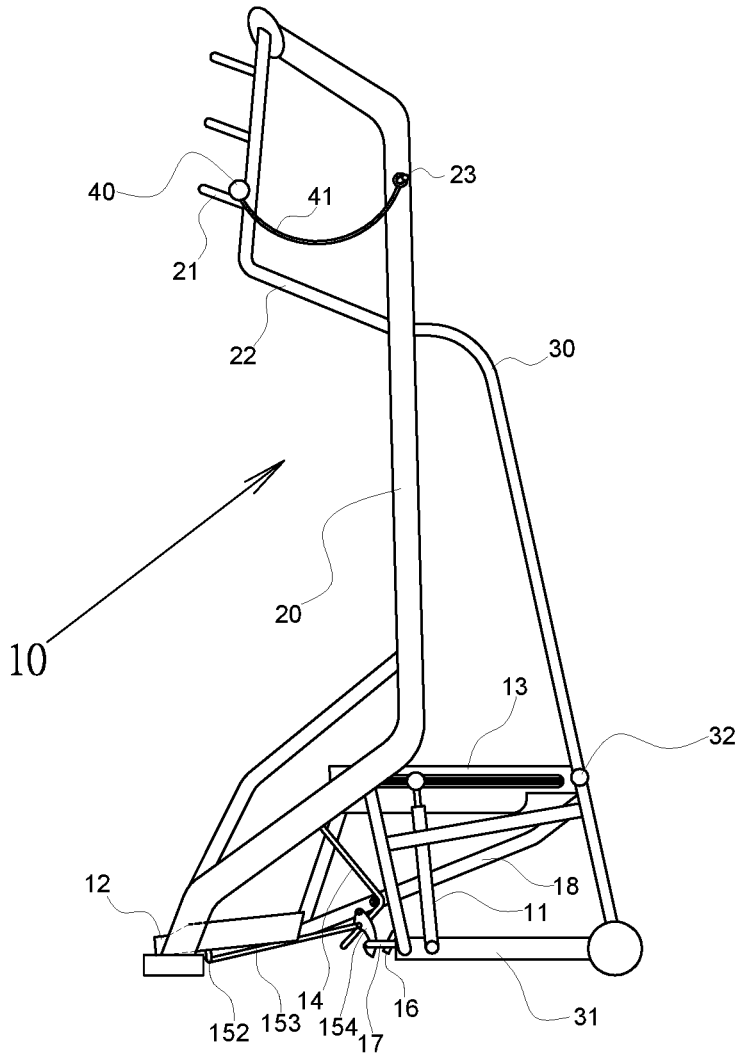
FIG. 3 is a side view of the preferred embodiment of the invention, wherein the hand-operated switch unit is in an unlocked state.
Figure 4:
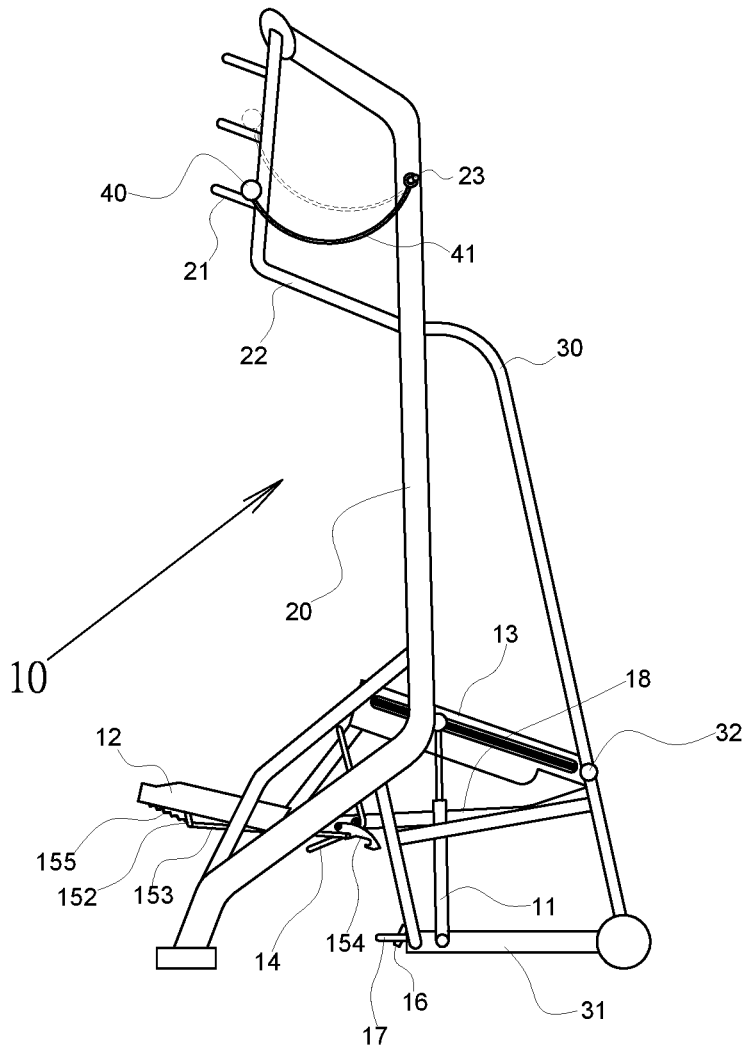
FIG. 4 is a side view of the preferred embodiment of the invention, wherein the support board is lifted to a high point.

As shown in FIGS. 2 and 3, before use, the user must first turn the hand-operated switch unit 14 upward (the position shown in FIG. 3) such that the other end thereof is detached from the corresponding barbed hooks 16. In this way, a smooth operation/use is then ensured. When not in use, the hand-operated switch unit 14 can be returned to the locked position (the position shown in FIG. 2), which forms the first safety measure of the present invention.

When the hand-operated switch unit 14 is released, the steps of operation are shown as follows:

Step 1: Set the auxiliary pushing force in advance by use of an external circuit operation interface (not shown) of the mechanism box unit 13;

Step 2: Stand on the support board 12 and make sure that both feet touch the foot-operated switch unit 15 to release the hooked state of the support board 12;

Step 3: Make sure to firmly hold the grip bar 40 to start the pull-up exercise (that is, the position and state shown in FIG. 4);

Step 4: When the support board 12 is in the upward movement state, the grip bar 40 can be randomly removed to the expected hanging bar 21 (as shown by the dotted line in FIG. 4). In this way, in the next upward movement of the support board 12, the grip bar 40 can be freely removed and continuously changed to any different hanging bar 21;

Step 5: Release the hand first before stop using it, but the user must still stand on the support board 12 and use natural gravity to lower the support board 12 to the lowest position. At this time, your feet can leave the foot-operated switch unit 15 so that the corresponding barbed hooks 16 exerts the expected hooking effect on the support board 12.

The reason why the operation and use steps are described is mainly because the movement process is like an interactive climbing state of high and low bars. Therefore, it is actually a very intense and slightly difficult exercise mode. In addition to its inevitable high level of fun, users must also fully understand how to operate and use it in order to truly exert its potential practical value.

During use, the other end of the safety sling 41 of the grip bar 40 must be fastened to two corresponding safety pin 23 disposed at appropriate places of the front frame 20 at all times. When the grip bar 40 is not hung in the expected hanging bar 21 in time and firmly, as long as the user firmly holds the grip bar 40 at all times. By using the function of the safety sling 41, the user's body is stabilized so as not to fall out of the machine, thereby ensuring the safety of the user.

Figure 5:
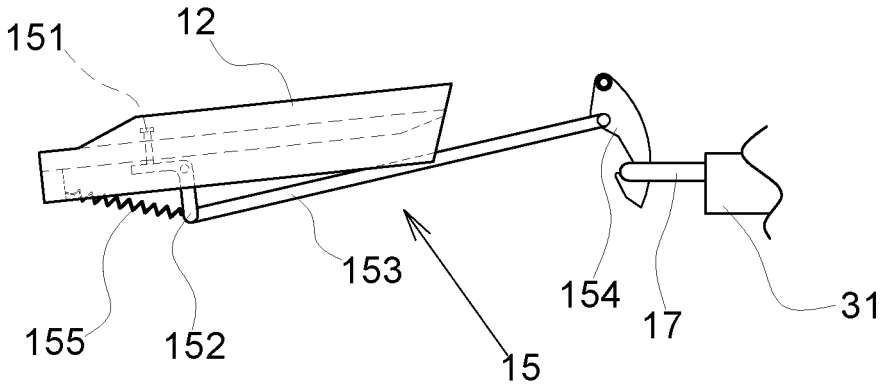
FIG. 5 is a partial view of the foot-operated switch unit according to the invention.
Figure 6:
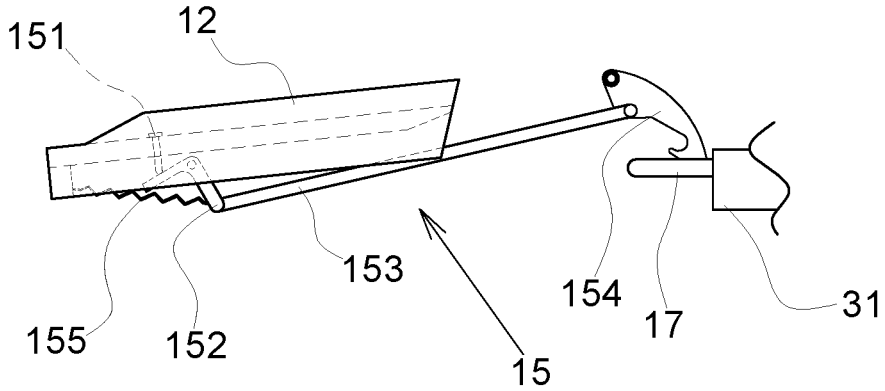
FIG. 6 is a schematic view of the operation of the foot-operated switch unit shown in FIG. 5.

As shown in FIGS. 1, 5 and 6, the foot-operated switch unit 15 actually has two left and right units, and the structures thereof are exactly the same. The foot-operated switch unit 15 includes a touch button 151 projecting from the support board 12, an angled swivel member 152 pivotally connected to the bottom of the support board 12, a linkage bar 153 and a hook 154 pivotally connected to the bearing plate link 18. An elastic element 155 for use of return is interposed between the support board 12 and the angled swivel member 152. Therefore, when the touch button 151 is actually pressed, the swinging displacement of the angled swivel member 152 causes the linkage bar 153 to move the hook 154 at the other end to swivel upward, thereby releasing the hooked state of the corresponding barbed hook 17 (see FIG. 6). In this way, the user may smoothly take the expected exercise. When the support board 12 is at the lowest position and any of the touch buttons 151 is not pressed (that is, when any foot of the user leaves the support board 12), the barbed hook 17 will automatically be returned by means of the elastic member 155 to the hooked position in the normal state, which forms the second safety measure of the present invention.

In particular, if the elastic member 155 is destroyed and loses its effect, the hook 154 will fall down due to its own gravity when it is not stressed, so that a constant hooking purpose can be also fulfilled without problem, thereby fully ensuring the operation safety.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A pull-up fitness exercise machine with a grip bar hanging frame structure for a hang-up training, comprising a support board, the support board being automatically lifted upward by a pushing unit for a user to take an expected pull-up exercise, the pushing unit being activated by an electric adjusting element in a mechanism box unit for a proper adjustment of the pushing force, the support board being provided with a hand-operated switch unit and a foot-operated switch unit for cooperating with their corresponding barbed hooks respectively, such that the support board can always be kept at a relatively low position in the case that the foot-operated switch group is not stressed, wherein a whole machine body consists of a left and right symmetrical front frame and a rear frame having a forward extension rail, and wherein a bottom end of the front frame naturally forms two front ground feet, and further forms a solid ground support together with a bottom end of the rear frame, and wherein the mechanism box unit and a supporting plate link are pivotally connected to a pivot shaft of the rear frame, and wherein the pushing unit is further pivoted between the mechanism box unit and the extension rail, and wherein a hanging frame having a plurality of corresponding hanging bars is positioned on both top ends of the front frame for providing a random hanging of a grip bar with a safety sling, wherein the foot-operated switch unit comprises:

a touch button projecting from the support board;

an angled swivel member pivotally connected to a bottom of the support board, wherein one end of the angled swivel member is in contact with a bottom of the touch button, while the other end thereof is pivotally connected with a linkage bar, and wherein the linkage bar includes two ends creating a pivotal connection with the angled swivel member and a hook respectively, and wherein the hook is pivotally connected to the support board and forms a hooking relationship with the barbed hook; and an elastic element interposed between the bottom of the support board and the angled swivel member.

2. The pull-up fitness exercise machine with the grip bar hanging frame structure for a hang-up training as recited in claim 1, wherein two safety pin are disposed near the top of the front frame.

* * * * *